United States Patent [19]

Steinberg et al.

[11] 4,043,155

[45] Aug. 23, 1977

[54] POSITIVE FEED DEVICE FOR KNITTING MACHINE

[75] Inventors: Robert Steinberg, Neponsit, N.Y.; Joseph Scotto di Carlo, Cornwells Heights, Pa.

[73] Assignee: Scorpio Industries, Inc., Neponsit, N.Y.

[21] Appl. No.: 727,089

[22] Filed: Sept. 27, 1976

[51] Int. Cl.[2] ..... D04B 15/48; D04B 35/14

[52] U.S. Cl. ..... 66/132 T; 66/146; 66/163; 242/147 R

[58] Field of Search ..... 66/132 T, 132 R, 146, 66/163; 242/147 R; 200/61.1 B

[56] References Cited

U.S. PATENT DOCUMENTS

| | | | |
|---|---|---|---|
| 1,169,185 | 1/1916 | Pasurka | 242/147 R |
| 1,714,126 | 5/1929 | Cocker | 200/61.18 |
| 1,977,686 | 10/1934 | Mayer | 66/132 |
| 2,399,403 | 4/1946 | St. Pierre | 66/132 X |
| 2,514,582 | 7/1950 | Johnson | 242/147 R |
| 3,271,979 | 9/1966 | Coile | 66/146X |
| 3,354,627 | 11/1967 | Cizek et al. | 200/61.18 X |
| 3,802,228 | 4/1974 | Deniega | 66/163 X |
| 3,950,966 | 4/1976 | di Carlo | 66/132 T |

FOREIGN PATENT DOCUMENTS

| | | | |
|---|---|---|---|
| 331,155 | 12/1920 | Germany | 66/132 |

*Primary Examiner*—Wm. Carter Reynolds
*Attorney, Agent, or Firm*—Pollock, VandeSande, & Priddy

[57] ABSTRACT

In a knitting machine positive feed device of the type comprising a rotatable roller having a bracket mounted for free pivotable motion adjacent the roller under the control of a pair of weighted arms which are attached to the bracket, the fixed yarn guides which are disposed adjacent the opposing ends of one of said arms are supplemented by an intervening movable yard guide which is weighted for movement under the influence of gravity to take up slack in the yarn caused by any overfeed from the roller. The movable yarn guide can also be associated with a stop-motion switching device operative to turn off the knitting machine if the yarn should break.

6 Claims, 2 Drawing Figures

POSITIVE FEED DEVICE FOR KNITTING MACHINE

Figures 1, 2:
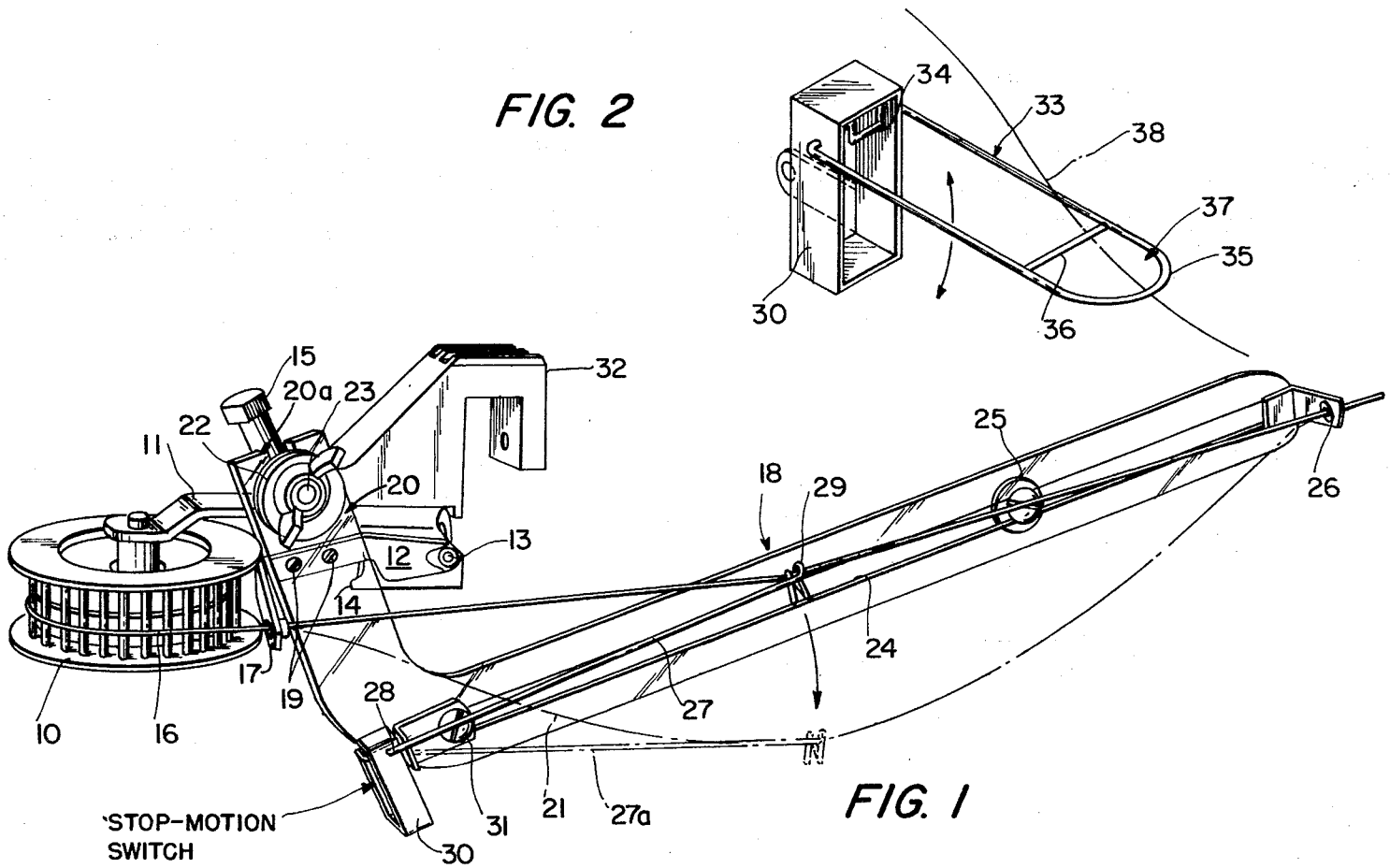

The present invention is concerned with positive feed devices for knitting machines of the type described in Scotto di Carlo U.S. Pat. No. 3,950,966, issued Apr. 20, 1976 for "Demand Responsive Positive Feed Device for Knitting Machine." The disclosure of said Scotto di Carlo patent is incorporated herein by reference since it provides a full disclosure of the structure and operation of the basic feed device to which the improvement of the present application is directed.

Briefly, as described in said Scotto di Carlo patent, a knitting machine is provided with a plurality of positive feed devices for feeding yarn from a plurality of yarn packages to a plurality of feeding stations. The positive feed devices are of the roller/tape type, corresponding generally to those described in Rosen U.S. Pat. No. 3,090,215, wherein a plurality of rotatable rollers are provided which are associated with a driven tape running along the surfaces of the rollers and having a width less than the axial dimension of each roller. In accordance with the particular form of feed device contemplated by the aforementioned Scotto di Carlo patent, the roller/tape positive feeding devices are provided with yarn guide structures each of which comprises a bracket having eyelets to guide the yarn along the running surface of the roller, and said brackets are mounted for free pivotable motion adjacent their respective rollers to position the length of yarn on the surface of the roller under the tape for positive feeding, or to displace the yarn away from the tape for nonfeed thereof. The position of the yarn guide is controlled by one or more weights which are attached to the bracket at positions displaced from the bracket pivot point to urge the bracket and its eyelets into the nonfeed position under the influence of gravity. When a particular yarn is demanded by a feeding station, the resulting tension in that particular yarn causes the bracket to pivot in the opposite direction against the force of the attached weight to shift the yarn guide into the positive feed position automatically. Subsequent release of tension in the yarn causes the weight to predominate, thereby to automatically return the yarn guide to its nonfeed position.

In positive feed devices of the type described above, and more fully described in the Scotto di Carlo patent, when the demand for a particular yarn ceases, the continued rotation of the roller as the yarn position is being displaced from its positive feed position to its nonfeed position, may sometime cause the roller to throw extra yarn toward the yarn guide means or eyelets. The resultant overfeed in the yarn produces slack in the yarn which may cause the yarn to lay incorrectly on the roller and/or the resultant excess yarn may wrap around the yarn guide means or eyelets closest to the roller with the result that proper feeding of the yarn thereafter is impeded, or the yarn may actually break. The improvement of the present invention is intended to obviate this problem.

In accordance with the present invention, the pair of yarn guides which are normally mounted in fixed position adjacent the opposing ends of the lower counterbalance arm in a positive feed device of the Scotto di Carlo type, are supplemented by a further yarn guide element which is weighted for movement under the influence of gravity, and which engages the length of yarn extending generally along said lower counterbalance arm at a position between the fixed yarn guides. In a preferred embodiment of the invention, this movable further yarn guide comprises an elongated wire member one end of which is pivotably attached to the lower counterbalance arm at a position on said arm remote from its free end, said elongated wire member extending from its point of pivotable attachment toward the free end of the lower counterbalance arm and having a loop therein through which the length of yarn passes. The comparatively light weight of this pivotably mounted wire member in engagement with the length of yarn operates under the influence of gravity to pull the length of yarn away from the roller thereby to take up any slack which may be caused by overfeed from the roller without putting any undue tension on the yarn.

The added movable yarn guide may, moreover, be associated with a stop-motion device which is not operated when the further yarn guide moves within limits normally associated with the taking up of slack in the yarn, but which may be caused to operate when the movement of said further yarn guide is so comparatively large as to be indicative of the fact that the yarn has broken.

The foregoing objects, advantages, construction and operation of the present invention will become more readily apparent from the subsequent description and accompanying drawings wherein:

FIG. 1 illustrates in perspective view an improved positive feed device constructed in accordance with a preferred embodiment of the present invention, and FIG. 2 is a detail view of an alternate form of wire member which can be used in the device of FIG. 1.

The basic structure and operation of the positive feed device to which the improvement of the present invention is directed, is described in detail in Scotto di Carlo U.S. Pat. No. 3,950,966, the disclosure of which is incorporated herein by reference, and will accordingly not be further described in detail hereinafter. Briefly, however, the device comprises a roller 10 which is mounted for rotation on a support structure 11 that includes a pair of side flanges that support a bracket 12 for free pivotal motion about a pivot axis 13 which extends transverse to the axis of rotation of roller 10. The bracket 12 is selectively caused to pivot through a limited arc, the lower extent of which is defined by a stop 14 and the upper extent of which is adjustably defined by a bolt 15 which is threaded through support structure 11. When bracket 12 is in its upper pivotal position, a length of yarn 16, passing around the running surface of roller 10 and thence through an eyelet or yarn guide 17 attached to bracket 12, is moved to an upper location on the running surface of the roller 10 in underlying relation to a positively driven tape (not shown) to provide positive feed for yarn 16; and when bracket 12 is in its lower pivotal position, the yarn 16 is displaced on the running surface of roller 10 to a nonfeed position below said tape.

The actual pivotal position of bracket 12 is responsive to the tension in the yarn 16, produced by the demand or nondemand of the knitting machine with which the positive feed device is associated, and is further responsive to gravity forces exerted on said bracket 12 by a counterbalance arrangement attached thereto. The counterbalance arrangement comprises an elongated L-shaped member 18 which may be fabricated of plastic or any other appropriate material, and which is attached to bracket 12 by screws 19 to define a first arm 20 which extends upwardly from bracket 12 in a generally vertical direction on one side of pivot 13, and a second arm 21 of elongated configuration which extends below and then rearward of bracket 12 in a generally horizontal direction on the other side of pivot 13. Arm 20 includes a slot 20a which opens into its free end and which is adapted to receive a weight consisting of a plurality of metal washers 22 which are retained in place by a bolt and associated wing nut 23. In generally analogous fashion, the elongated generally horizontal arm 21 includes an elongated interior slot 24 which supports a weight 25 therein again consisting of a plurality of washers and an associated bolt and wing nut. The weights thus provided on arms 20 and 21 may be selectively varied by increasing or decreasing the number of washers employed, and the actual position of each weight relative to pivot point 13 may be selectively varied by loosening the wing nut forming a portion of said weight, displacing the weight to the desired position in its associated slot, and then retightening said wing nut.

The length of yarn 16 passes through an eyelet or yarn guide means 17 which is disposed adjacent one of the opposing ends of elongated arm 21, extends in a generally horizontal direction along elongated arm 21 through a further yarn guide or eyelet 26 which is attached to arm 21 adjacent the other opposing end of said arm, i.e., adjacent its free end, and then passes in a downward direction to a feeding station in the knitting machine in the manner, and for the purposes, described in the aforementioned Scotto di Carlo patent.

In the absence of demand by the knitting machine for yarn 16, the weights associated with arms 20 and 21 pivot bracket 12 into the nonfeed position. When the machine makes demand for the yarn 16, the resultant tension produced in said yarn applies a downward force to yarn guide 26 which causes bracket 12 to pivot in a clockwise direction (in the drawing) against the force of the counterbalance means to displace yarn 16 on the running surface of roller 10 into the positive feed position. When demand for the yarn thereafter ceases, the counterbalance means again moves the yarn into its nonfeed position on the running surface of the roller 10. It has been found that a problem sometimes arises as the yarn is translated between its positive feed and nonfeed positions and, more particularly, it has been found that when demand for the yarn ceases and the yarn is shifted on the running surface of roller 10 to its nonfeed position, the continued rotation of roller 10 due to continued movement of its associated tape nevertheless sometimes throws extra yarn toward eyelet 17 which causes the length of the yarn extending between eyelets 17 and 26 to exhibit slack. If the slack is sufficiently large, it may sometimes wrap around or snarl on eyelet 17 whereby the yarn may break when it is subsequently demanded by the knitting machine. Alternatively, the slack may cause some delay, at the time of next demand, in displacement of the yarn on the running surface of roller 10 from its nonfeed to its positive feed position.

In order to obviate these problems, the present invention contemplates the provision of means for applying a comparatively light but positive force to the length of yarn extending between eyelets 17 and 26, sufficient to take up any slack which may be caused by overfeed without putting any undue tension on the yarn. The preferred arrangement contemplated by the present invention for achieving this result is shown in the drawing, and consists of an elongated wire member 27 which is pivotally attached at one end 28 thereof to arm 21 and which extends from its point of pivotal attachment toward the free end of arm 21. Wire member 27 is provided with a helical end 29 which is disposed substantially midway between eyelets 17 and 26 and which provides an open sided loop into which the length of yarn between eyelets 17 and 26 may be slipped.

When the knitting machine is making positive demand for yarn 16, the tension on the length of yarn extending from eyelet 17 through loop 29 and thence through eyelet 26 holds wire member 27 in the uper pivotal position shown in full line in the drawing. However when demand for the yarn ceases, and any slack occurs in the yarn due to overfeed, the weight of the elongated wire member 27 is operative to effect a pivotal motion of said wire member 27 about its pivoted end 28, into the position shown at **27*a*. As a result of this freely pivotal action of wire member 27 under the influence of gravity, any slack in the yarn caused by the overfeed is taken up in the region between eyelets 17 and 26** without, however, placing any undue tension or strain on the yarn in this region.

The pivotal end 28 of the elongated wire member may be directly attached to arm 21. Alternatively, the pivotal end 28 of member 27 can be mounted in a housing or fixture such as 30 which is in turn attached to arm 21, e.g., by a bolt 31 passing through slot 24. When this latter form of structure is employed, moreover, the housing 30 can optionally include a switch element forming a portion of a stop-motion device which is responsive to the pivotal motion of the elongated wire member 27. So long as that pivotal motion is confined within the limits normally associated with the taking up of slack, the stop-motion switch in housing 30 is not actuated. However if the yarn should actually break, the wire member 27 will fall under the influence of gravity to a position significantly below that designated **27*a* in the drawing, and this will in turn actuate the stop-motion switch in housing 30**, e.g., by closing a contact therein, to de-energize or otherwise deactivate the knitting machine.

The overall device is mounted in position on the knitting machine by a fixture 32 which is attached to support structure 11.

FIG. 2 illustrates an alternative form of elongated wire member which can be used in place of wire member 27. In this alternative form, the wire member 33 is of elongated substantially U-shaped configuration, with the plane defined by the sides of said U-shaped wire member being disposed transverse to the plane of arm 21. The legs of said U-shaped member extend transverse to the direction of pivotal motion of said wire member, are pivotally attached to housing 30 as illustrated, and are joined to one another within said housing by an offset wire portion 34 which restricts lateral movement of member 33 relative to the sides of housing 30. The U-shaped member 33 is smoothly rounded at its free end to provide an arcuate nose 35 which cooperates with a wire piece 36 extending between the sides of member 33 and spot welded thereto to define a closed loop 37 through which a length of yarn may be threaded, as at 38, for the purposes already described. Instead of adding a separate piece 36 to form the loop, a wire member of the overall general U-shape shown in FIG. 2 can be formed by bending a single length of wire to form the closed loop 37 with the sides of the U-shaped member extending integrally from said loop for attachment, at the ends of said sides remote from said loop, to housing 30.

While we have thus described preferred embodiments of the present invention, many variations will be apparent to those skilled in the art. It must therefore be understood that the foregoing description is intended to be illustrative only and not limitative of the present invention; and all such variations and modifications as are in accord with the principles described are meant to fall within the scope of the appended claims.

Having thus described our invention, we claim:

1. In a knitting machine positive feed device of the type comprising a rotatable roller, a bracket adjacent said roller mounted for free pivotal movement through a limited arc about a pivot axis extending transverse to the axis of rotation of the roller, counterbalance means attached to said bracket and comprising a pair of weighted arms located on opposite sides of said pivot axis, at least one of said arms being of elongated configuration and oriented in a generally horizontal direction, said one of said arms having a pair of opposing ends one of which is a free end, and a pair of yarn guides disposed respectively adjacent the said opposing ends of said one of said arms for guiding a length of yarn from the running surface of said roller in the generally horizontal direction of extension of said one arm toward the said free end of said one arm and thence to a feeding station in said knitting machine, the improvement comprising further yarn guide means in engagement with said length of yarn at a position between said pair of yarn guides, said further yarn guide means comprising an elongated wire member one end of which engages said length of yarn and the other end of which is pivotably attached to said one of said arms, said elongated wire member extending in a generally horizontal direction from its point of pivotal attachment generally along the direction of extension of said one of said arms to its point of engagement with said length of yarn, the weight of said elongated wire member being operative, upon the occurrence of slack in said length of yarn due to overfeed of said yarn by said roller, to effect free movement of said wire member about its point of pivotal attachment and relative to said pair of yarn guides under the influence of gravity for taking up said slack

2. The improvement of claim 1 wherein said elongated wire member is pivotally attached to said one of said arms at a position on said arm remote from the free end of said one of said arms, said elongated wire member extending from its point of pivotal attachment toward said free end of said arm, said elongated wire member including a loop therein at a position remote from the pivotally attached end of said wire member, through which loop said length of yarn passes in transit from said roller toward the free end of said one of said arms, whereby the weight of said elongated wire member is operative, upon occurrence of slack in said length of yarn, to effect pivotal motion of said wire member about its pivotally attached end thereby to take up said slack.

3. The improvement of claim 2 including switch means adjacent said elongated wire member and responsive to pivotal movement of said wire member beyond a predetermined position for controlling the operation of said knitting machine.

4. The improvement of claim 2 including a housing attached to said one of said arms at a position remote from the free end of said arm, said other end of said elongated wire member being pivotally mounted in said housing.

5. The improvement of claim 4 including switch means in said housing responsive to pivotal motion of said elongated wire member beyond a predetermined position for stopping the operation of said knitting machine.

6. The improvement of claim 2 wherein said elongated wire member is of substantially U-shaped configuration, the legs of said U-shaped wire member being disposed in a plane which extends transverse to the direction of pivotal motion of said wire member.

* * * * *